US005725111A

United States Patent [19]

Choi

[11] Patent Number: 5,725,111

[45] Date of Patent: Mar. 10, 1998

[54] WINDOW MOUNTED DRYING RACK

[76] Inventor: Eunha Choi, 140-36 Negundo Ave., Flushing, N.Y. 11355

[21] Appl. No.: 703,633

[22] Filed: Aug. 27, 1996

[51] Int. Cl.[6] ..... A47F 5/00

[52] U.S. Cl. ..... 211/119.1; 211/87; 211/104; 211/106; 211/99

[58] Field of Search ..... 211/86, 88, 90, 211/99, 106, 150, 170, 105.1, 229.15, 104; 248/539, 562; 280/650

[56] References Cited

U.S. PATENT DOCUMENTS

| | | | |
|---|---|---|---|
| 1,466,859 | 9/1923 | Sutton | 211/99 |
| 1,621,176 | 3/1927 | Sonin | 248/229.15 |
| 1,905,574 | 4/1933 | Sternberg | 211/104 |
| 2,568,598 | 9/1951 | Traverso | 211/104 |
| 2,956,689 | 10/1960 | Van Der Togt | 211/86 |
| 3,040,739 | 6/1962 | Grieshaber | 248/229.15 |
| 4,687,188 | 8/1987 | Knurek et al. | 267/140 |
| 4,974,807 | 12/1990 | Moineau | 248/539 |
| 4,997,093 | 3/1991 | Letteri, Jr. | 211/86 |
| 5,505,318 | 4/1996 | Goff | 211/90 |

*Primary Examiner*—Robert W. Gibson, Jr.

[57] ABSTRACT

A window mounted drying rack adapted for use in association with a window frame and a window sill, the apparatus comprises a rack formed in a generally rectangular configuration and including a rear axle, a front bar and two parallel side bars, a plurality of interior rods being coupled between the side bars along the entire length of the side bars; and a clamp assembly including at least two C-shaped mounting members, each mounting member being pivotally coupled to the rear axle of the rack, two knobs each having a gripping end and a threaded upper end, each upper end being threadedly coupled through each C-shaped member, in an operative orientation each C-shaped member of the clamping assembly being positioned around a window sill, the knobs being tightened by a user to secure the clamps upon the window sill, a user then draping clothes over the rack and across the internal rods to affect drying of clothes.

4 Claims, 3 Drawing Sheets

WINDOW MOUNTED DRYING RACK

BACKGROUND OF THE INVENTION

1. Field of the Invention

The present invention relates to a window mounted drying rack and more particularly pertains to drying clothes by coupling the apparatus to a window frame.

2. Description of the Prior Art

The use of drying racks is known in the prior art. More specifically, drying racks heretofore devised and utilized for the purpose of drying laundry and other articles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,901,871 to Ohm discloses a drying rack.

U.S. Pat. No. 4,131,205 to Malecki discloses a clothes-drying rack.

U.S. Pat. No. Des. 321,423 to Ohm discloses a laundry drying rack.

U.S. Pat. No. 5,044,507 to Shulyak discloses a collapsible drying rack.

U.S. Pat. No. 4,127,195 to Portnoy discloses a clothes dryer rack.

U.S. Pat. No. 4,094,414 to Thiot discloses a clothes hanging rack.

While these devices fulfill their respective, particular objective and requirements, the aforementioned patents do not describe a window mounted drying rack for drying clothes by coupling the apparatus to a window frame.

In this respect, the window mounted drying rack according to the present invention substantially departs from the conventional concepts and designs of the prior art, and in doing so provides an apparatus primarily developed for the purpose of drying clothes by coupling the apparatus to a window frame.

Therefore, it can be appreciated that there exists a continuing need for new and improved window mounted drying rack which can be used for drying clothes by coupling the apparatus to a window frame. In this regard, the present invention substantially fulfills this need.

SUMMARY OF THE INVENTION

In the view of the foregoing disadvantages inherent in the known types of drying racks now present in the prior art, the present invention provides an improved window mounted drying rack. As such, the general purpose of the present invention, which will be described subsequently in greater detail, is to provide a new and improved window mounted drying rack and method which has all the advantages of the prior art and none of the disadvantages.

To attain this, the present invention essentially comprises a new and improved window mounted drying rack adapted for use in association with a window frame and a window sill, the apparatus comprising, in combination: a rack formed in a generally rectangular configuration and including a rear axle, a front bar and two parallel side bars, a plurality of interior rods being coupled between the side bars along the entire length of the side bars, the interior rods having a smaller diameter than the bars and being positioned parallel to the front bar and rear axle, the rear axle having a greater length than the front bar and rods, the rear axle having two free ends each including a bore extending therein, the side bars having a front extent formed contiguously with the front bar, the side bars having a rear extent affixed to the rear axle; two brackets each being formed in an elongated generally rectangular configuration with a rounded upper extent and a linear lower extent, each bracket having an inner face and an outer face, the outer face of each bracket including an outer grove, the inner face of each bracket including a cylindrical bore positioned therein adjacent its upper end, a small circular aperture extending through the approximate center point of each bore, two inserts each being formed in a cylindrical configuration with an outer flange, one insert being affixed within each bore in the ends of the rear axle, the free ends of the axle being positioned within the recesses of the brackets, each flange including a plurality of detents extending therefrom, each recess within the respective brackets including a plurality of indents, the detents of the flanges adapted to be positioned within the indents of the brackets, the interior end of each insert having plurality of screw threads, an adjustment knob being positioned through each bracket and threadedly coupled within each insert, each adjustment knob having an intermediate flange positioned within the outer groove of each bracket, the user loosening the adjustment knobs to permit angle adjustment of the rack, a user tightening the adjustment knobs to lock the rack in place; and a clamp assembly including two C-shaped mounting members, each mounting member including a vertical segment affixed to each bracket, each C-shaped member further including upper and lower horizontal segments, the lower segment of each C-shaped member having a central threaded aperture extending therethrough, a metal plate including an upper surface coated with rubber and positioned adjacent to the lower segment of each C-shaped member, two clamp knobs each having a cylindrical gripping end and a threaded upper end, each upper end being coupled through the threaded aperture in the lower segment of each C-shaped member and affixed within the metal plate thereof, in an operative orientation each C-shaped member of the clamping assembly being positioned around a window sill, the rubber coated metal plate engaging the lower surface of the window sill, the clamp knobs being tightened by a user to secure the clamps upon the window sill, a user then draping clothes over the rack and across the internal rods to affect drying of clothes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved window mounted drying rack which has all the advantages of the prior art drying racks and none of the disadvantages.

It is another object of the present invention to provide a new and improved window mounted drying rack which may be easily and efficiently manufactured and marketed.

It is a further object of the present invention to provide a new and improved window mounted drying rack which is of durable and reliable construction.

An even further object of the present invention is to provide a new and improved window mounted drying rack which is susceptible of a low cost of manufacture with regard to both materials and labor, and which accordingly is then susceptible of low prices of sale to the consuming public, thereby making such a window mounted drying rack economically available to the buying public.

Still yet another object of the present invention is to provide a new and improved window mounted drying rack which provides in the apparatuses and methods of the prior art some of the advantages thereof, while simultaneously overcoming some of the disadvantages normally associated therewith.

Even still another object of the present invention is to provide a new and improved window mounted drying rack for drying clothes by coupling the apparatus to a window frame.

Lastly, it is an object of the present invention to provide a new and improved window mounted drying rack adapted for use in association with a window frame and a window sill, the apparatus comprising: a rack formed in a generally rectangular configuration and including a rear axle, a front bar and two parallel side bars, a plurality of interior rods being coupled between the side bars along the entire length of the side bars; and a clamp assembly including at least two C-shaped mounting members, each mounting member being pivotally coupled to the rear axle of the rack, two knobs each having a gripping end and a threaded upper end, each upper end being threadedly coupled through each C-shaped member, in an operative orientation each C-shaped member of the clamping assembly being positioned around a window sill, the knobs being tightened by a user to secure the clamps upon the window sill, a user then draping clothes over the rack and across the internal rods to affect drying of clothes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
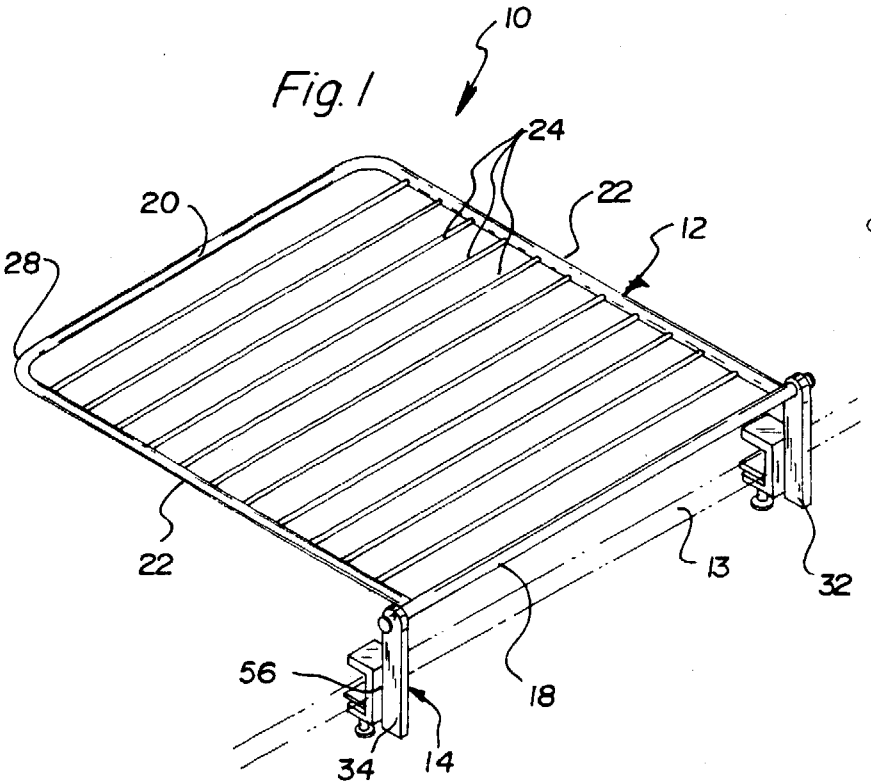
FIG. 1 is a perspective view of the preferred embodiment of the window mounted drying rack constructed in accordance with the principles of the present invention.

With reference now to the drawings, and in particular, to FIG. 1 thereof, the preferred embodiment of the new and improved window mounted drying rack embodying the principles and concepts of the present invention and generally designated by the reference number 10 will be described.

Specifically, it will be noted in the various Figures that the device relates to a window mounted drying rack 10. In its broadest context, the device consists of a rack 12, two brackets 14 and a clamp assembly 16. Such components are individually configured and correlated with respect to each other so as to attain the desired objective.

The window mounted drying rack 10 is adapted for use in association with a window frame and a window sill 13. In the operative orientation the clamp assembly of the apparatus is coupled to the window sill and the rack extends outside the window so that laundry positioned on the rack can dry quickly. Note FIG. 1.

Figure 2:
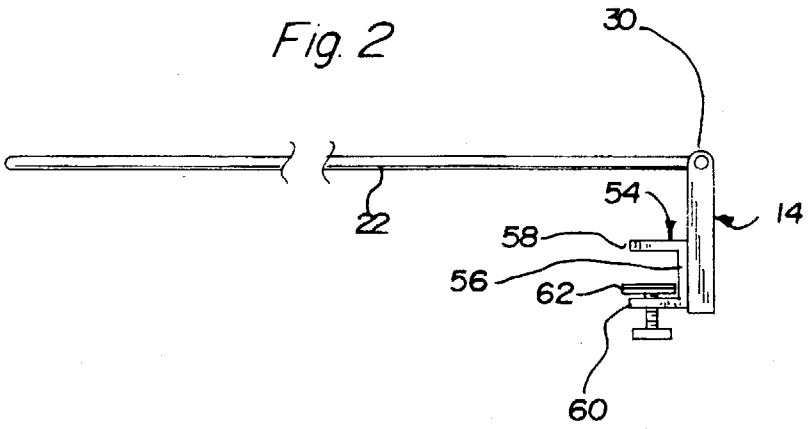
FIG. 2 is a side perspective view of the apparatus shown in FIG. 1.

The rack 12 is fabricated of plastic and formed in a generally rectangular configuration and includes a rear axle 18, a front bar 20 and two parallel side bars 22. The width of the front bar is about twenty two inches. The length of the side bars is about thirty three inches. A plurality of interior rods 24 are coupled between the side bars along the entire length of the side bars. The interior rods have a smaller diameter than the bars and are positioned parallel to the front bar and rear axle. The spaces between the rods are sufficiently large to permit hanging of clothes over the rods. Note FIGS. 1 and 2.

Figure 3:
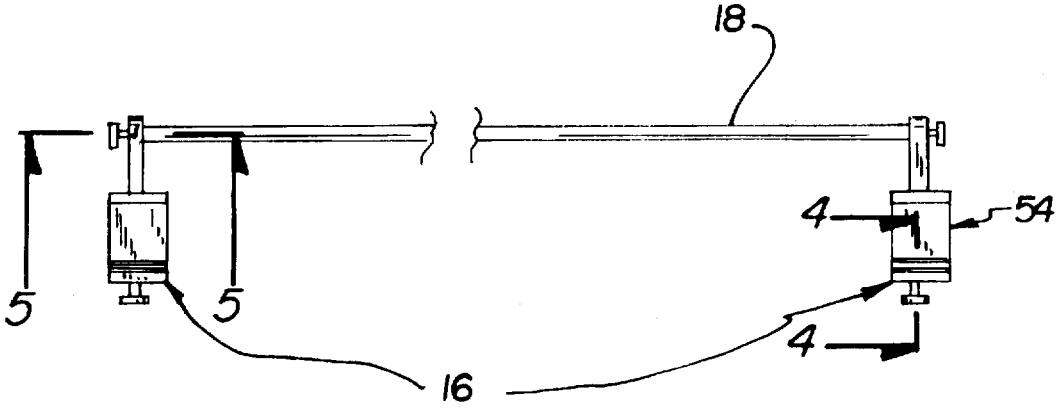
FIG. 3 is an end view of the apparatus shown in FIG. 1.

The rear axle 18 has a greater length than the front bar and rods. The rear axle has two free ends 26 each including a bore extending within them. The side bars have a front extent formed contiguously with the front bar. The area of intersection 28 between the front and side bars is rounded to prevent injuries during use. The side bars have a rear extent affixed to the rear axle. Note FIGS. 1 and 3.

Figure 5:
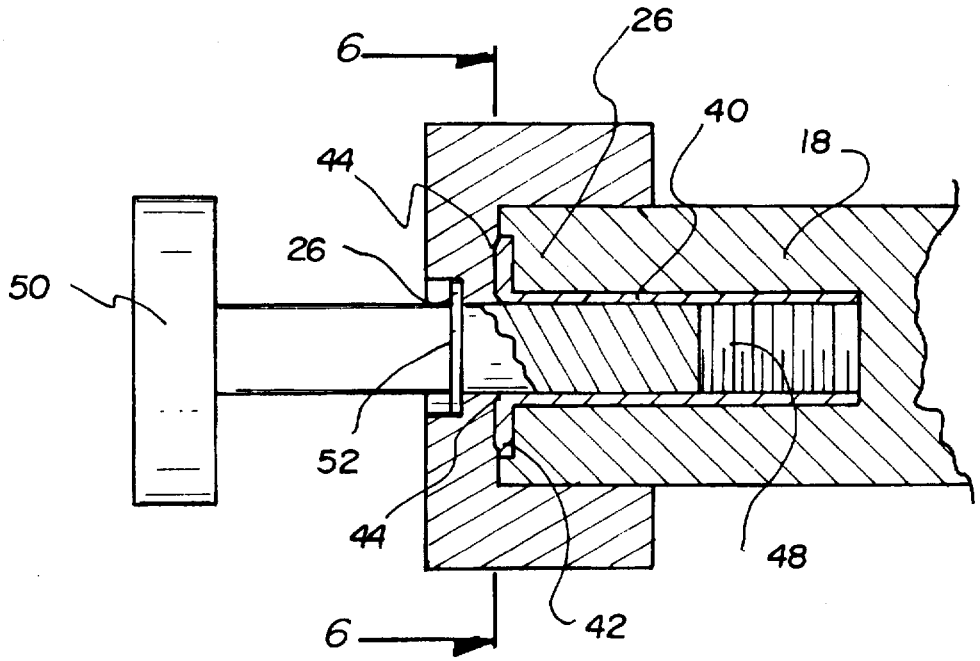
FIG. 5 is a cross sectional view taken along section line 5—5 of FIG. 3 illustrating the angle adjustment device of the apparatus.

Two brackets 14 are each formed in an elongated generally rectangular configuration with a rounded upper extent 30 and a linear lower extent. The height of each bracket is about eight inches. Each bracket has an inner face 32 and an outer face 34. The outer face of each bracket includes a circular outer groove 36 positioned adjacent its upper end. The inner face of each bracket includes a cylindrical bore positioned within it adjacent its upper end and opposite the outer groove. A small circular aperture extends through the approximate center point of each bore and outer groove. Note FIG. 5.

Two inserts 40 are each formed in a cylindrical configuration with an outer flange 42. One insert is affixed within each bore in the ends of the rear axle. The free ends of the axle are positioned within the recesses of the brackets. Each flange includes a plurality of detents 44 extending from it. Each recess within the respective brackets includes a plurality of indents 46. The detents of the flanges are adapted to be positioned within the indents of the brackets. The interior end of each insert has plurality of screw threads 48. An adjustment knob 50 is positioned through each bracket and is threadedly coupled within each insert. Each adjustment knob has an intermediate flange 52 positioned within the outer groove of each bracket. Note FIG. 5.

Figure 6:
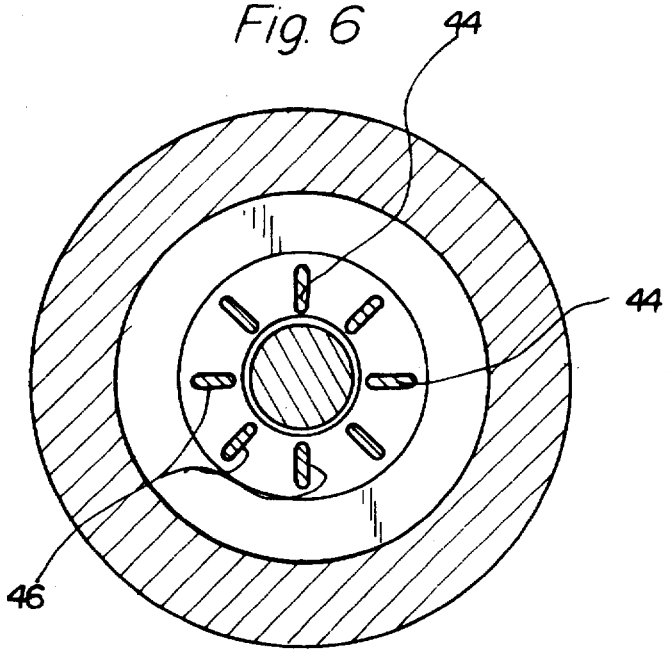
FIG. 6 is a cross sectional view taken along section line 6—6 of FIG. 5.

When the user desires to change the angle of the rack with respect to the window sill, he first loosens the adjustment knobs. This action moves the intermediate flange 52 to a position flush with the outer surface of the brackets and also separates of the rear axle from the brackets. The user then pivots the rack to the desired angle and tightens the adjustment knobs. Tightening of the knobs causes the detents 44 to become locked within the indents 46 thereby securing the rack at the desired angle. Note FIGS. 5 and 6.

A clamp assembly 16 includes two C-shaped mounting members 54. Each mounting member includes a vertical segment 56 affixed to each bracket. Each C-shaped member 54 further includes upper 58 and lower 60 horizontal segments. The lower segment of each C-shaped member has a central threaded aperture extending through it. Note FIGS. 1–3.

Figure 4:
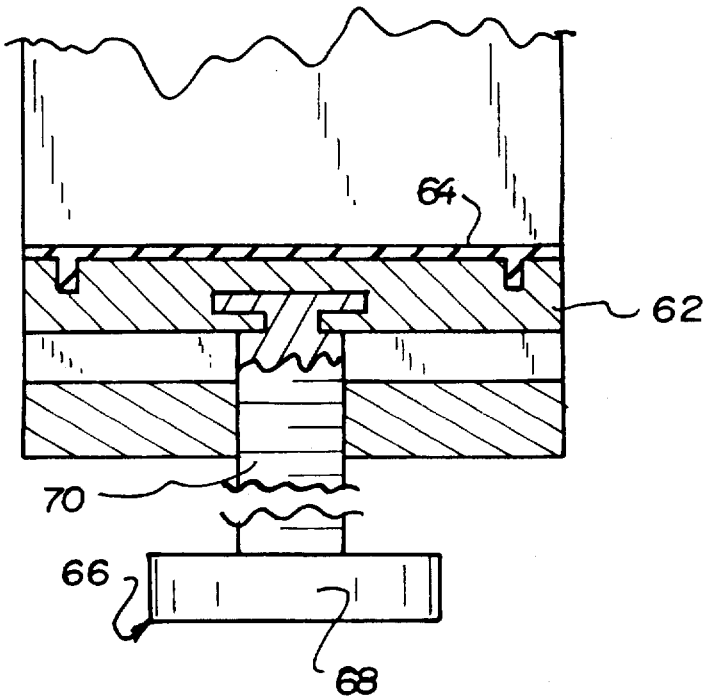
FIG. 4 is a cross sectional view taken along section line 4—4 of FIG. 3 illustrating the clamp assembly of the apparatus.

A metal plate 62 includes an upper surface coated with rubber 64 and positioned adjacent to the lower segment of each C-shaped member. Two clamp knobs 66 each have a cylindrical gripping end 68 and a threaded upper end 70. Each upper end is coupled through the threaded aperture in the lower segment 60 of each C-shaped member and affixed within the metal plate. In an operative orientation each C-shaped member of the clamping assembly 16 is positioned around a window sill 13. The rubber coated metal plate engages the lower surface of the window sill to prevent scratching and denting of the sill. The rubber surface also helps prevent slippage during use. The clamp knobs are tightened by a user to secure the clamps upon the window sill. A user then drapes clothes over the rack and across the internal rods to affect drying of clothes. Note FIGS. 3 and 4.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved window mounted drying rack apparatus comprising, in combination:

a rack formed in a generally rectangular configuration and including a rear axle, a front bar and two parallel side bars, a plurality of interior rods being coupled between the side bars along the entire length of the side bars, the interior rods having a smaller diameter than the bars and being positioned parallel to the front bar and rear axle, the rear axle having a greater length than the front bar and rods, the rear axle having two free ends each including a bore extending therein, the side bars having a front extent formed continuously with the front bar, the side bars having a rear extent affixed to the rear axle;

two brackets each being formed in an elongated generally rectangular configuration with a rounded upper extent and a linear lower extent, each bracket having an inner face and an outer face, the outer face of each bracket including an outer groove, the inner face of each bracket including a cylindrical bore positioned therein adjacent its upper end, a small circular aperture extending through the approximate center point of each bore, two inserts each being formed in a cylindrical configuration with an outer flange, one insert being affixed within each bore in the ends of the rear axle, the free ends of the axle being positioned within the recesses of the brackets, each flange including a plurality of detents extending therefrom, each recess within the respective brackets including a plurality of indents, the detents of the flanges adapted to be positioned within the indents of the brackets, the interior end of each insert having a plurality of screw threads, and adjustment knob being positioned through each bracket and threadedly coupled within each insert, each adjustment knob having an intermediate flange positioned within the outer groove of each bracket, loosening the adjustment knobs functioning to permit angle adjustment of the rack, tightening of the adjustment knobs functioning to lock the rack in place; and a clamp assembly including two C-shaped mounting members, each mounting member including a vertical segment affixed to each bracket, each C-shaped member further including upper and lower horizontal segments, the lower segment of each C-shaped member having a central threaded aperture extending therethrough, a metal plate including an upper surface coated with rubber positioned adjacent to the lower segment of each C-shaped member, two clamp knobs each having a cylindrical gripping end and a threaded upper end, each upper end being coupled through the threaded aperture in the lower segment of each S-shaped member and affixed within the metal plate thereof, in an operative orientation each C-shaped member of the clamping assembly being positioned round a window sill, the rubber coated metal plate engaging the lower surface of the window sill, the clamp knobs being tightened by a user to secure the clamps unto the window sill, a user then draping clothes over the rack and across the internal rods to affect drying of clothes.

2. A window mounted drying rack apparatus comprising:

a rack formed in a generally rectangular configuration and including a rear axle, a front bar and two parallel side bars, a plurality of interior rods being coupled between the side bars along the entire length of the side bars; and a clamp assembly including two C-shaped mounting members, each mounting member being pivotally coupled to the rear axle of the rack, two knobs each having a gripping end and a threaded upper end, each upper end being threadedly coupled through each C-shaped member, in an operative orientation each C-shaped member of the clamping assembly being positioned around a window sill, the knobs being tightened by a user to secure the clamps upon the window sill, the rack thus functioning to support clothes for drying.

3. The window mounted drying rack as set forth in claim 2 and further including:

two brackets each having an upper extent, an inner face and an outer face, the inner face including a cylindrical bore positioned therein adjacent its upper end, a small circular aperture extending through the approximate center point of each bore, two inserts each being formed in a cylindrical configuration with an outer flange, one insert being affixed within the ends of the rear axle, the free ends of the axle being positioned within the recesses of the brackets, a knob being coupled through each bracket and within the rear axle, the brackets being coupled to the clamp assembly, the rear axle, knob and bracket including coupling means to permit angle adjustment of the rack with respect to a cooperatively coupled window sill.

4. The window mounted drying rack as set forth in claim 3 and wherein the coupling means is a plurality of detents extending from the flange, and wherein each recess within the respective brackets includes a plurality of indents, the detents of the flanges adapted to be positioned within the indents of the brackets, the interior end of each insert having a plurality of screw threads, a knob being positioned through each bracket and threadedly coupled within each insert, the user loosening the knobs to permit angle adjustment of the rack, a user tightening the knobs to lock the rack in place.

* * * * *